US008927478B2

(12) United States Patent
Reinhardt et al.

(10) Patent No.: US 8,927,478 B2
(45) Date of Patent: Jan. 6, 2015

(54) USE OF MANGANESE OXALATES AS BLEACH CATALYSTS

(75) Inventors: Gerd Reinhardt, Kelkheim (DE); Michael Best, Bad Soden (DE); Joachim Erbes, Frankfurt am Main (DE)

(73) Assignee: Clariant International Ltd., Muttenz, CA (US)

( * ) Notice: Subject to any disclaimer, the term of this patent is extended or adjusted under 35 U.S.C. 154(b) by 0 days.

(21) Appl. No.: 13/060,836

(22) PCT Filed: Aug. 26, 2009

(86) PCT No.: PCT/EP2009/006162

§ 371 (c)(1),
(2), (4) Date: Feb. 25, 2011

(87) PCT Pub. No.: WO2010/022918

PCT Pub. Date: Mar. 4, 2010

(65) Prior Publication Data

US 2011/0166055 A1 Jul. 7, 2011

(30) Foreign Application Priority Data

Aug. 30, 2008 (DE) ..... 10 2008 045 215

(51) Int. Cl.

| | |
|---|---|
| ***C11D 7/04*** | (2006.01) |
| ***C11D 7/38*** | (2006.01) |
| ***C11D 7/54*** | (2006.01) |
| ***C11D 3/39*** | (2006.01) |
| ***C11D 3/20*** | (2006.01) |

(52) U.S. Cl.

CPC ..... *C11D 3/3932* (2013.01); *C11D 3/391* (2013.01); *C11D 3/3917* (2013.01); *C11D 3/3905* (2013.01); *C11D 3/2086* (2013.01)

USPC ..... 510/221; 510/220; 510/224; 510/235; 510/238; 510/303; 510/309; 510/31; 510/313; 510/372; 510/376; 510/378; 510/501; 510/506

(58) Field of Classification Search

CPC .... C11D 3/2086; C11D 3/3905; C11D 3/391; C11D 3/3917; C01B 15/01; C01B 15/10; C01B 15/12

USPC ..... 510/220, 221, 224, 235, 238, 303, 309, 510/311, 313, 372, 376, 378, 501; 252/186.27, 186.3, 186.33

See application file for complete search history.

(56) References Cited

U.S. PATENT DOCUMENTS

| | | | | |
|---|---|---|---|---|
| 3,532,634 | A | 10/1970 | Woods | |
| 4,414,127 | A | 11/1983 | Fu | |
| 4,626,373 | A | 12/1986 | Finch et al. | |
| 5,106,523 | A * | 4/1992 | Peterson | 8/648 |
| 5,118,436 | A * | 6/1992 | Aoyagi et al. | 252/186.42 |
| 6,734,155 | B1 * | 5/2004 | Herbots et al. | 510/392 |
| 6,875,734 | B2 | 4/2005 | Reinhardt et al. | |
| 7,094,745 | B2 | 8/2006 | Jonas et al. | |
| 2001/0044402 | A1 * | 11/2001 | Dai et al. | 510/375 |
| 2003/0162681 | A1 | 8/2003 | Hage et al. | |
| 2003/0199697 | A1 * | 10/2003 | Pratap et al. | 546/171 |
| 2006/0046946 | A1 * | 3/2006 | van Buskirk | 510/367 |
| 2006/0293204 | A1 * | 12/2006 | Kaneda et al. | 510/376 |
| 2011/0146723 | A1 | 6/2011 | Reinhardt et al. | |

FOREIGN PATENT DOCUMENTS

| | | |
|---|---|---|
| DE | 44 43 177 | 6/1996 |
| DE | 19909546 | 6/2000 |
| DE | 102005027619 | 12/2006 |
| EP | 0 072 166 | 2/1983 |
| EP | 0 082 563 | 6/1983 |
| EP | 0 141 470 | 5/1985 |
| EP | 0 157 483 | 10/1985 |
| EP | 0 237 111 | 9/1987 |
| EP | 0765381 | 12/1995 |
| EP | 0909809 | 4/1999 |
| EP | 1 445 305 | 8/2004 |
| EP | 1 520 910 | 4/2005 |
| WO | WO 95/34628 | 12/1995 |
| WO | WO 01/45842 | 6/2001 |
| WO | WO 02/48301 A1 | 6/2002 |
| WO | WO 02/068574 A1 | 9/2002 |
| WO | WO 03/104234 A1 | 12/2003 |
| WO | WO 2005/112631 | 12/2005 |

OTHER PUBLICATIONS

McGraw-Hill Dictionary of Scientific & Technical Terms, Manganese Oxalate, (2003).*

Mc-Graw Hill Dictionary of Scientific and Technical Terms, 6 ed., 2003 (manganese oxalate).*

English Abstract for DE19909546, dated Jun. 29, 2000.

International Search Report for PCT/EP2009/006162 dated Nov. 10, 2009.

Translation of International Preliminary Report on Patentability for PCT/EP2009/006162, May 26, 2011.

A. Huizing et al., Mat. Res. Bull. vol. 12, pp. 605-6166, 1977.

B. Donkova et al., Thermochimica Acta, vol. 421, pp. 141-149, 2004.

English Abstract for DE 44 43 177, dated Jun. 13, 1996.

(Continued)

*Primary Examiner* — Gregory R DelCotto
(74) *Attorney, Agent, or Firm* — Michael W. Ferrell

(57) ABSTRACT

The invention relates to the use of manganese oxalates in detergents and cleaning agents, in particular in cleaning agents containing peroxy compounds for hard surfaces.

8 Claims, No Drawings

(56) References Cited

OTHER PUBLICATIONS

Borzel, Heidi, et al, "Iron coordination chemistry with tetra-, penta-andhexadentate bispidine-type ligands", Inorganica Chimica Acta, 337(2002), pp. 407-419.
Siener, Tom et al: "Synthesis and Opioid Receptor Affinity of a Series of 2,4-Diaryl- Substituted 3,7-Diazabicyc1ononanones", Journal of Medicinal Chemistry , 43(2000), pp. 3746-3751, Sep. 13, 2000.
Seifen-Öle-Fette-Wachse, vol. 116, No. 20/1990 on pp. 805-808.
T.H. Bennur et al., Journal of Molecular Catalysis A: Chemical 185 (2002) 71-80).
Eur. J. Org. Chem. (2008) 1019-1030.
International Search Report for PCT/EP2009/006163 dated Nov. 20, 2009.
Translation of International Preliminary Report on Patentability for PCT/EP2009/006163, May 26, 2011.

* cited by examiner

USE OF MANGANESE OXALATES AS BLEACH CATALYSTS

The present invention relates to the use of manganese oxalates for enhancing the bleaching action of especially inorganic peroxygen compounds in the bleaching of colored stains, especially on hard surfaces, and to cleaning compositions for hard surfaces, comprising such manganese oxalates.

Inorganic peroxygen compounds, especially hydrogen peroxide and solid peroxygen compounds which dissolve in water to release hydrogen peroxide, such as sodium perborate and sodium carbonate perhydrate, have been used for some time as oxidizing agents for disinfection and bleaching purposes. In dilute solutions, the oxidizing action of these substances depends greatly on the temperature; for example, with $H_2O_2$ or perborate in alkaline bleaching liquors, sufficiently rapid bleaching of soiled textiles is achieved only at temperatures above about 80° C. At lower temperatures, the oxidizing action of the inorganic peroxygen compounds can be improved by addition of bleach activators, for which numerous proposals have become known in the literature, in particular from the substance classes of the N- or O-acyl compounds, for example polyacylated alkylenediamines, especially tetraacetylethylenediamine, and acylated glycolurils such as tetraacetylglycoluril, and also carboxylic anhydrides, especially phthalic anhydride, carboxylic esters, especially sodium nonanoyloxybenzenesulfonate, sodium lauroylbenzenesulfonate or decanoyloxybenzoic acid, and acylated sugar derivatives such as pentaacetylglucose. In the more recent literature, a series of nitrile derivatives have also been claimed for this end use, especially cationic nitrile quats. Addition of these substances can enhance the bleaching action of aqueous peroxide liquors to such an extent that essentially the same effects occur at temperatures around 60° C. as with the peroxide liquor alone at 95° C.

In the effort to obtain energy-saving washing and bleaching processes, use temperatures distinctly below 60° C., especially below 45° C. down to below cold water temperature, have been gaining increasing significance in the last few years.

At these low temperatures, the action of the activator compounds known to date generally declines noticeably. There has therefore been no lack of effort to develop more effective systems for this temperature range, but no convincing success has been reported to date. A starting point in this direction has been the use of transition metal salts and complexes as bleach catalysts. The metal complexes, if they ensure good soil removal at all under the conditions of the cleaning process, are usually characterized by a complex synthesis and associated high production costs of the complex ligand.

In addition, a series of relatively simple manganese compounds have been described, which cause a certain bleaching efficacy under washing and cleaning conditions in combination with persalts. These include manganese/EDTA complexes as in EP 0 141 470 or manganese sulfate/picolinic acid mixtures as claimed in U.S. Pat. No. 3,532,634, or else manganese(II) or (III) salts in combination with carbonates (EP 0 082 563), fatty acids (U.S. Pat. No. 4,626,373), phosphonates (EP 0 072 166), hydroxycarboxylic acids (EP 0 237 111) or citric acid or salts thereof (EP 0 157 483). However, none of the combinations mentioned has significant cleaning performance on persistent tea stains on hard surfaces. It is additionally known that oxalate ions have a positive effect on manganese-catalyzed epoxidations in the presence of trimethyl-1,4,7-triazacyclononane (T. H. Bennur et al., Journal of Molecular Catalysis A: Chemical 185 (2002) 71-80).

It has now been found that the use of manganese oxalates in washing and cleaning composition formulations has advantages over physical mixtures consisting of manganese salts and oxalic acid. These include volume reduction of the bleach catalyst with the same or better bleaching performance, lower hygroscopicity and associated increased storage stability in the formulations.

The invention provides for the use of manganese oxalates as bleach catalysts in washing and cleaning compositions.

Manganese oxalates can be prepared in a manner known per se by reacting manganese salts with oxalic acid in water. Examples thereof are, inter alia, in A. Huizing et al., Mat. Res. Bull. Vol. 12, pp 605-6166, 1977 and B. Donkova et al., Thermochimica Acta, Vol. 421, pp. 141-149, 2004. For the inventive use, both the white manganese(II) oxalate dihydrate and the pink manganese(II) oxalate trihydrate are options. Even though they possess only very low water solubility, these compounds surprisingly exhibit good bleaching performance in combination with inorganic peroxygen compounds. Owing to their sparing solubility, they also have better storage stability in alkaline washing and cleaning composition formulations compared to other manganese salts such as manganese(II) sulfate, manganese(II) acetate, manganese(III) acetate or manganese(II) chloride. Compared to physical mixtures of manganese salts and oxalic acid or salts thereof, the inventive manganese oxalates are more volume-effective bleach catalysts, which is an advantage especially in the case of use in machine dishwasher detergent tablets.

The invention also provides washing and cleaning compositions comprising manganese oxalates.

In addition to a peroxygen compound, these washing and cleaning compositions comprise preferably 0.025 to 2.5% by weight and especially 0.05 to 1.5% by weight of bleach-boosting manganese oxalates. In a particular embodiment, the manganese oxalates can also be combined with oxalic acid, which increases the water solubility thereof. The manganese oxalate:oxalic acid ratio in this case may correspond to 1:0 to 1:5 parts by weight.

Useful peroxygen compounds include hydrogen peroxide, but primarily alkali metal perborate mono- or tetrahydrate and/or alkali metal percarbonate, sodium being the preferred alkali metal. The use of sodium percarbonate has advantages especially in cleaning compositions for dishware, since it has a particularly favorable effect on the corrosion behavior of glasses. The bleaching agent based on oxygen is therefore preferably an alkali metal percarbonate, especially sodium percarbonate.

The amounts of peroxygen compounds used are generally selected such that between 10 ppm and 10% active oxygen, preferably between 50 ppm and 5000 ppm of active oxygen, is present in the solutions.

An addition of small amounts of known bleach stabilizers, for example of phosphonates, borates or metaborates and metasilicates, and also magnesium salts such as magnesium sulfate, may be appropriate to the purpose.

In addition to the inventive manganese oxalates, it is possible to use conventional bleaching activators, i.e. compounds which, under perhydrolysis conditions, give rise to optionally substituted perbenzoic acid and/or peroxocarboxylic acids having 1 to 10 carbon atoms, especially 2 to 4 carbon atoms. Suitable bleach activators are the customary bleach activators which are cited at the outset and bear O- and/or N-acyl groups with the number of carbon atoms mentioned and/or optionally substituted benzoyl groups. Preference is given to polyacylated alkylenediamines, especially tetraacetylethylenediamine (TAED), acylated glycolurils, especially tetraacetylglycoluril (TAGU), acylated triazine derivatives, especially 1,5-diacetyl-2,4-dioxohexahydro-1,3,5-triazine (DADHT), acylated phenylsulfonates, especially nonanoyl- or isononanoyloxybenzene-sulfonate, acylated polyhydric alcohols, especially triacetin, ethylene glycol diacetate and 2,5-diacetoxy-2,5-dihydrofuran, and also acetylated sorbitol and mannitol, and acylated sugar derivatives, especially pentaacetylglucose (PAG), pentaacetylfructose, tetraacetylxylose and octa-acetyllactose, and also acetylated, optionally N-alkylated glucamine and gluconolactone. The combination of conventional bleach activators known from German patent application DE 44 43 177 may also be used. In a preferred embodiment of the inventive use, simultaneously with the manganese oxalate and the hydrogen peroxide-generating compound, such a compound which releases peroxocarboxylic acid under perhydrolysis conditions is also used. In a preferred embodiment of inventive compositions, 1 to 10% by weight, especially 2 to 6% by weight, of such a compound which releases peroxocarboxylic acid under perhydrolysis conditions is present.

The term "bleaching" is understood here to mean both the bleaching of soil present on the hard surface, especially tea, and the bleaching of soil which has been detached from the hard surface and is present in the dishwashing liquor.

The invention further relates to a process for cleaning hard surfaces, especially of dishware, with the aid of aqueous solutions optionally comprising further cleaning composition constituents, especially peroxygen-based oxidizing agents, and to cleaning compositions for hard surfaces, especially cleaning compositions for dishware, and among these preferably those for use in machine cleaning processes and comprising the manganese oxalates.

The inventive use consists essentially in creating, on a hard surface contaminated with colored stains, conditions under which a peroxidic oxidizing agent and the manganese oxalates can react with one another, with the aim of obtaining more strongly oxidizing conversion products. Such conditions are present especially when the reactants encounter one another in aqueous solution. This can be accomplished by separate addition of the peroxygen compound and of the manganese oxalate to an optionally detergent-containing solution. However, the process according to the invention is performed particularly advantageously with use of a cleaning composition for hard surfaces, which comprises a manganese oxalate and optionally a peroxygen-containing oxidizing agent. The peroxygen compound can also be added to the solution separately, in substance or as a preferably aqueous solution or suspension, when a peroxygen-free cleaning composition is used.

The inventive cleaning compositions, which may be present in the form of granules, pulverulent or tableted solids, or as other shaped bodies, homogeneous solutions or suspensions, may in principle comprise, apart from the manganese oxalate mentioned, all known ingredients customary in such compositions. The inventive compositions may especially comprise builder substances, surfactants, peroxygen compounds, water-miscible organic solvents, sequestrants, electrolytes, pH regulators, and further assistants such as silver corrosion inhibitors, foam regulators, additional peroxygen activators, and dyes and fragrances.

An inventive cleaning composition for hard surfaces may further comprise abrasive constituents, especially from the group comprising quartz flours, wood flours, ground polymers, chalks and glass microspheres, and mixtures thereof. Abrasives present in the inventive cleaning compositions preferably do not exceed 20% by weight, and are especially from 5 to 15% by weight.

The invention further provides a composition for machine cleaning of dishware, comprising 15 to 65% by weight and especially 20 to 60% by weight of water-soluble builder component, 5 to 25% by weight and especially 8 to 17% by weight of oxygen-based bleach, based in each case on the overall composition, and in each case 0.05 to 1.5% by weight of manganese oxalate. Such a composition is especially of low alkalinity, i.e. the 1 percent by weight solution thereof has a pH of 8 to 11.5 and preferably 9 to 11.

Useful water-soluble builder components in inventive cleaning compositions are in principle all the builders used customarily in compositions for the machine cleaning of dishware, for example alkali metal phosphates, which may be present in the form of the alkaline, neutral or acidic sodium or potassium salts thereof. Examples thereof are trisodium phosphate, tetrasodium diphosphate, disodium dihydrogendiphosphate, pentasodium triphosphate, what is known as sodium hexametaphosphate, and the corresponding potassium salts or mixtures of sodium and potassium salts. The amounts thereof may be within the range of up to about 60% by weight, especially 5 to 20% by weight, based on the overall composition. Further possible water-soluble builder components are, as well as polyphosphonates and phosphonatoalkyl carboxylates, for example, organic polymers of native or synthetic origin of the polycarboxylate type, which act as cobuilders especially in hard water regions. Useful examples are polyacrylic acids and copolymers formed from maleic anhydride and acrylic acid, and the sodium salts of these polymer acids. Commercial products are, for example, Sokalan™ CP 5, CP 10 and PA 30 from BASF. The polymers of native origin usable as cobuilders include, for example, oxidized starch and polyamino acids, such as polyglutamic acid or polyaspartic acid. Further possible builder components are naturally occurring hydroxycarboxylic acids, for example mono-, dihydroxysuccinic acid, alpha-hydroxypropionic acid and gluconic acid. The preferred organic builder components include the salts of citric acid, especially sodium citrate. Useful sodium citrate includes anhydrous trisodium citrate and preferably trisodium citrate dihydrate. Trisodium citrate dihydrate can be used in the form of finely or coarsely crystalline powder. Depending on the pH ultimately established in the inventive compositions, it is also possible for the acids corresponding to the cobuilder salts mentioned to be present.

The enzymes optionally present in inventive compositions include proteases, amylases, pullulanases, cutinases and/or lipases, for example proteases such as BLAP™, Optimase™, Opticlean™, Maxacal™, Maxapem™, Durazym™, Purafect™ OxP, Esperase™ and/or Savinase™, amylases such as Termamyl™, Amylase-LT™, Maxamyl™, Duramyl™, and/or lipases such as Lipolase™, Lipomax™, Lumafast™ and/or Lipozym™. The enzymes used may be adsorbed onto carriers and/or embedded into coating substances, in order to protect them from premature inactivation. They are present in the inventive cleaning compositions preferably in amounts up to 10% by weight, especially of 0.05 to 5% by weight, particular preference being given to using enzymes stabilized against oxidative degradation.

The inventive machine dishwasher detergents preferably comprise the customary alkali carriers, for example alkali metal silicates, alkali metal carbonates and/or alkali metal hydrogencarbonates. The alkali carriers typically used include carbonates, hydrogencarbonates and alkali metal silicates having a molar $SiO_2/M_2O$ ratio (M=alkali metal atom) of 1:1 to 2.5:1. Alkali metal silicates may be present in amounts of up to 40% by weight and especially 3 to 30% by weight, based on the overall composition. The alkali carrier system used with preference in the inventive compositions is a mixture of carbonate and hydrogencarbonate, preferably sodium carbonate and hydrogencarbonate, which may be present in an amount of up to 50% by weight, preferably 5 to 40% by weight.

In a further embodiment of inventive compositions, 20 to 60% by weight of water-soluble organic builders, especially alkali metal citrate, 3 to 20% by weight of alkali metal carbonate and 3 to 40% by weight of alkali metal disilicate are present.

It is optionally also possible to add to the inventive compositions surfactants, especially anionic surfactants, zwitterionic surfactants and preferably low-foaming nonionic surfactants, which serve for better detachment of greasy stains, as wetting agents, and possibly as granulating aids in the course of production of the cleaning compositions. The amount thereof may be up to 20% by weight, especially up to 10% by weight, and is preferably in the range from 0.5 to 5% by weight. Typically, extremely low-foaming compounds are used, especially in cleaning compositions for use in machine dishwashing processes. These include preferably $C_{12}$-$C_{18}$-alkyl polyethylene glycol-polypropylene glycol ethers having in each case up to 8 mol of ethylene oxide and propylene oxide units in the molecule. However, it is also possible to use other known low-foaming nonionic surfactants, for example $C_{12}$-$C_{18}$-alkyl polyethylene glycol-polybutylene glycol ether having in each case up to 8 mol of ethylene oxide and butylene oxide units in the molecule, end group-capped alkyl polyalkylene glycol mixed ethers, and the foaming but ecologically attractive $C_8$-$C_{14}$-alkyl polyglucosides having a degree of polymerization of about 1 to 4 and/or $C_{12}$-$C_{14}$-alkyl polyethylene glycols having 3 to 8 ethylene oxide units in the molecule. Likewise suitable are surfactants from the family of the glucamides, for example alkyl-N-methylglucamides, in which the alkyl moiety originates preferably from a fatty alcohol having carbon chain length $C_6$-$C_{14}$. It is advantageous in some cases when the surfactants described are used as mixtures, for example the combination of alkyl polyglycoside with fatty alcohol ethoxylates or of glucamide with alkyl polyglycosides. The presence of amine oxides, betaines and ethoxylated alkylamines is also possible.

In order to bring about silver corrosion protection, it is possible to use silver corrosion inhibitors in inventive cleaning compositions for dishware. Preferred silver anticorrosives are organic sulfides such as cystine and cysteine, di- or trihydric phenols, optionally alkyl- or aryl-substituted triazoles such as benzotriazole, isocyanuric acid, and salts and/or complexes of titanium, of zirconium, of hafnium, of cobalt or of cerium, in which the metals mentioned may be present in one of the oxidation states II, Ill, IV, V or VI according to the metal.

In order to prevent glass corrosion during the rinse cycle, corresponding inhibitors can be used in inventive cleaning compositions for dishware. Particularly advantageous here are crystalline sheet silicates and/or zinc salts. The crystalline sheet silicates are sold, for example, by Clariant under the Na-SKS trade name, for example Na-SKS-1 ($Na_2Si_{22}O_{45}.xH_2O$, kenyait), Na-SKS-2 ($Na_2Si_{14}O_{29}.\times H_2O$, magadiit), Na-SKS-3 ($Na_2Si_8O_{17}.\times H_2O$) or Na-SKS-4 ($Na_2Si_4O_9.\times H_2O$, makatit). Suitable among these are in particular Na-SKS-5 (alpha-$Na_2Si_2O_5$), Na-SKS-7 (beta-$Na_2Si_2O_5$, natrosilit), Na-SKS-9 ($NaHSi_2O_5.H_2O$), Na-SKS-10 ($NaHSi_2O_5.3H_2O$, kanemit), Na-SKS-11 (t-$Na_2Si_2O_5$), and Na-SKS-13 ($NaHSi_2O_5$), but especially Na-SKS-6 (delta-$Na_2Si_2O_5$). An overview of crystalline sheet silicates can be found, for example, in the article published in "Seifen-Öle-Fette-Wachse, volume 116, No. 20/1990" on pages 805-808.

Preferred machine dishwasher detergents or machine dishwashing rinse aids have, in the context of the present application, a proportion by weight of the crystalline sheet silicate of 0.1 to 20% by weight, preferably of 0.2 to 15% by weight and especially of 0.4 to 10% by weight, based in each case on the total weight of these compositions.

In a further preferred embodiment, inventive machine dishwasher detergents or machine dishwashing rinse aids comprise at least one zinc salt selected from the group of the organic zinc salts, preferably from the group of the soluble organic zinc salts, more preferably from the group of the soluble zinc salts of monomeric or polymeric organic acids, especially from the group of zinc acetate, zinc acetylacetonate, zinc benzoate, zinc formate, zinc lactate, zinc gluconate, zinc ricinoleate, zinc abietate, zinc valerate and zinc p-toluenesulfonate.

Preferred machine dishwasher detergents or machine dishwashing rinse aids in the context of the present application are considered to be those in which the proportion by weight of the zinc salt, based on the total weight of this composition, is 0.1 to 10% by weight, preferably 0.2 to 7% by weight and especially 0.4 to 4% by weight, irrespective of which zinc salts are used, i.e. more particularly irrespective of whether organic or inorganic zinc salts, soluble or insoluble zinc salts, or mixtures thereof are used.

When the cleaning compositions foam too greatly in use, for example in the presence of anionic surfactants, it is possible also to add to them up to 6% by weight, preferably about 0.5 to 4% by weight, of a foam-suppressing compound, preferably from the group of the silicone oils, mixtures of silicone oil and hydrophobized silica, paraffins, paraffin-alcohol combinations, hydrophobized silica, the bis fatty acid amides, and other known commercially available defoamers. Further optional ingredients in the inventive compositions are, for example, perfume oils.

The organic solvents usable in the inventive compositions, especially when they are in liquid or pasty form, include alcohols having 1 to 4 carbon atoms, especially methanol, ethanol, isopropanol and tert-butanol, diols having 2 to 4 carbon atoms, especially ethylene glycol and propylene glycol, and mixtures thereof and the ethers derivable from the compound classes mentioned. Suitable water-miscible solvents present in the inventive cleaning compositions preferably do not exceed 20% by weight, and are especially from 1 to 15% by weight.

To establish a desired pH which does not arise automatically by the mixing of the remaining components, the inventive compositions may comprise system-compatible and environmentally compatible acids, especially citric acid, acetic acid, tartaric acid, malic acid, lactic acid, glycolic acid, succinic acid, glutaric acid and/or adipic acid, but also mineral acids, especially sulfuric acid or alkali metal hydrogensulfates, or bases, especially ammonium hydroxides or alkali metal hydroxides. Such pH regulators present in the inventive compositions preferably do not exceed 10% by weight, and are especially from 0.5 to 6% by weight.

The production of the inventive solid compositions does not present any difficulties and can be effected in a manner known in principle, for example by spray drying or granulation, in which case peroxygen compound and bleach catalyst are optionally added separately at a later stage.

Inventive cleaning compositions in the form of aqueous solutions or those comprising other customary solvents are particularly advantageously produced by simply mixing the ingredients, which can be added to an automatic mixer in substance or as a solution.

The inventive compositions are preferably in the form of pulverulent, granular or tableted preparations, which can be produced in a manner known per se, for example by mixing, granulating, roller compacting, and/or by spray drying the thermally stressable components and adding the more sensitive components, which include especially enzymes, bleaches and the bleach catalyst.

The procedure for production of inventive cleaning compositions in tablet form is preferably to mix all constituents with one another in a mixer, and to press the mixture by means of conventional tableting presses, for example eccentric presses or rotary presses, with pressures in the range from $200\times10^5$ Pa to $1500\times10^5$ Pa.

Fracture-resistant tablets which nevertheless have sufficiently rapid solubility under use conditions and have flexural strengths of normally more than 150 N are thus obtained without any problem. A tablet produced in such a way preferably has a weight of 15 to 40 g, especially of 20 to 30 g, with a diameter of 35 to 40 mm.

Inventive compositions can be produced in the form of powders and/or granules which do not form dust, have stable free flow in the course of storage and have high bulk densities in the range from 800 to 1000 g/l by mixing, in a first stage of the process, the builder components with at least a proportion of liquid mixture components with an increase in the bulk density of this preliminary mixture, and then—if desired after intermediate drying—combining the further constituents of the composition, including the bleach catalyst, with the preliminary mixture thus obtained.

Inventive compositions for cleaning dishware can be used either in domestic machine dishwashers or in commercial dishwashers. The addition is effected by hand or by means of suitable metering devices. The use concentration in the cleaning liquor is generally about 1 to 8 g/l, preferably 2 to 5 g/l.

A machine rinse program is generally supplemented and completed by some intermediate rinse cycles, which follow the cleaning cycle and use clear water, and a clear-rinse cycle with a conventional rinse aid. After drying, when inventive compositions are used, completely clean and hygienically impeccable dishware is obtained.

EXAMPLES

Preparation of Manganese(II) Oxalate Dihydrate

A 10 l four-neck round-bottom flask with a stirrer, thermometer and reflux condenser was initially charged with 176.0 g (1.95 mol) of oxalic acid in 4200 ml of water, and the resulting solution was admixed dropwise at room temperature with a solution of 318.6 g (1.30 mol) of manganese(II) acetate tetrahydrate in 2100 ml of water, and stirred for a further 15 min after the addition had ended. Subsequently, the reaction mixture was heated to reflux and stirred for a further 30 min. After cooling to room temperature, the white precipitate was filtered off with suction, washed three times with 200 ml of water each time and dried in a vacuum drying cabinet at room temperature overnight.

This gave 226.5 g of white crystalline manganese(II) oxalate dihydrate.

Examples 1-5

A cleaning composition (V1) comprising 44 parts by weight of sodium tripolyphosphate, 30 parts by weight of sodium carbonate, 10% by weight of SKS-6 sheet silicate, 10 parts by weight of sodium perborate monohydrate, 1.5 parts by weight each of protease and amylase granules, 3 parts by weight of nonionic surfactant and 2 parts by weight of N,N,N'N'-tetraacetylethylenediamine (TAED) in granule form, and cleaning compositions according to the invention (M1 to M3), the composition of which was as V1 except that they contained inventive manganese oxalates, were tested for their tea-removing properties. V2 and V3 are further noninventive manganese salts or mixtures consisting of manganese salts and oxalic acid as comparative examples.

To produce standardized tea stains, teacups were immersed 25 times into a tea solution at 70° C. Subsequently, a little of the tea solution was introduced into each teacup and the cup was dried in a drying cabinet.

The wash tests were carried out in a Miele G 688 SC machine dishwasher at 45° C. using water of water hardness 21° dH in the presence of 100 g of IKW test soil. The stain removal was subsequently assessed visually on a scale from 0 (=unchanged, very significant staining) to 100% (=no staining).

TABLE 1

| Test product | Assessment |
|---|---|
| V1 (Detergent) | 37% |
| V2 (Detergent + 100 mg of Mn(II) sulfate) | 55% |
| V3 (Detergent + 50 mg of Mn(II) $SO_4$ + 50 mg of oxalic acid) | 73% |
| M1 (Detergent + 100 mg of Mn(II) oxalate dihydrate) | 80% |
| M2 (Detergent + 100 mg of Mn(III) oxalate trihydrate) | 78% |
| M3 (Detergent + 50 mg of Mn(II) oxalate dihydrate) | 65% |

The assessments of the inventive compositions M1 to M3 reported in table 1 are significantly better than the value for the comparative product V1 and the comparative tests V2 and V3.

It is evident that a significantly better bleaching action can be achieved by virtue of the inventive use.

Essentially the same results were obtained when the sodium perborate was replaced by sodium percarbonate.

The invention claimed is:

1. A process for enhancing the bleaching action of an inorganic peroxygen compound in the bleaching of colored stains comprising the step of adding a bleach catalyst, wherein the bleach catalyst is a manganese(II) oxalate dihydrate or a manganese(II) oxalate trihydrate, to a washing and/or cleaning composition comprising the inorganic peroxygen compound wherein the inorganic peroxygen compound is hydrogen peroxide, alkali metal perborate mono- or tetrahydrate and/or alkali metal percarbonate, and wherein bleaching components of the washing and/or cleaning composition consist of: said inorganic peroxygen compounds; from 0.025 to 2.5% by weight of manganese (II) oxylate dihydrate or a manganese (II) oxylate trihydrate; and optionally (i) a bleach stabilizer selected from phosphonates, borates, metaborates, metasilicates and magnesium salts and/or (ii) a bleaching activator which releases an optionally substituted perbenzoic acid and/or peroxocarboxylic acid under perhydrolysis conditions.

2. A process as claimed in claim 1, wherein the alkali metal is sodium.

3. A process as claimed in claim 1, further comprising the step of adding free oxalic acid to the washing and/or cleaning composition.

4. A process as claimed in claim 1, wherein said bleach activator is tetraacetylethylenediamine.

5. A process as claimed in claim 1, wherein the manganese oxalate is present in an amount between 0.05 to 1.5% by weight.

6. A process as claimed in claim 1, wherein the washing and cleaning composition is a cleaning composition for hard surfaces.

7. A process as claimed in claim 1, wherein the washing and cleaning composition is a dishwashing detergent.

8. A process as claimed in claim 1, wherein the amount of peroxygen composition is selected such that between 50 ppm and 5,000 ppm of active oxygen is present in the washing or cleaning composition.

* * * * *